United States Patent [19]

Frind et al.

[11] 4,392,035

[45] Jul. 5, 1983

[54] VACUUM INTERRUPTER

[75] Inventors: Gerhard Frind, Altamont; James J. Carroll, Clifton Park; John H. Van Noy, Ballston Spa, all of N.Y.

[73] Assignee: General Electric Company, Schenectady, N.Y.

[21] Appl. No.: 270,056

[22] Filed: Jun. 3, 1981

[51] Int. Cl.[3] ..... H01H 33/66

[52] U.S. Cl. ..... 200/144 B

[58] Field of Search ..... 200/144 A, 144 B, 279

[56] References Cited

U.S. PATENT DOCUMENTS

| | | | |
|---|---|---|---|
| 3,321,599 | 5/1967 | Lee | 200/144 B |
| 3,462,572 | 8/1969 | Sofianek | 200/144 B |
| 3,522,399 | 7/1970 | Crouch | 200/279 |
| 3,679,474 | 7/1972 | Rich | 313/217 |
| 3,852,555 | 12/1974 | Schuocker et al. | 200/144 B |

FOREIGN PATENT DOCUMENTS 1093495 12/1967 United Kingdom .

OTHER PUBLICATIONS

H. Habler et al., "Vacuum Interrupter for Primary Distribution Circuit-Breakers", Siemens Review, No. 12, Dec. 1977, pp. 556-559.

C. W. Kimblin, "Dielectric Recovery and Shield-Currents in Vacuum-Arc Interrupters", Proceedings of the IEEE Power Apparatus Systems, vol. 90 (1971), pp. 1261-1270.

*Primary Examiner*—J. R. Scott

*Attorney, Agent, or Firm*—Lawrence D. Cutter; James C. Davis, Jr.; Marvin Snyder

[57] ABSTRACT

Improvement of the peak current interruption performance of a vacuum interrupter is obtained by configuring the conductive leads to the vacuum interrupter in a manner whereby the magnetic field generated by current in the conductive leads and impinging upon the space between a pair of contacts of the vacuum interrupter is minimized, thereby resulting in better performance of the vacuum interrupter.

22 Claims, 3 Drawing Figures

VACUUM INTERRUPTER

BACKGROUND OF THE INVENTION

The present invention relates to vacuum interrupters, and more particularly to configurations of the conductive leads which are connected to vacuum interrupters.

In FIG. 1, schematically illustrating prior art, there is shown a vacuum interrupter 10 with prior art conductive leads 11 and 12 providing a path for current that is subject to interruption by the vacuum interrupter 10. The vacuum interrupter 10 shown is a conventional vacuum interrupter comprising first and second, separable contacts 14 and 15. The first and second contacts 14 and 15 comprise spiral finger portions 14*a*–14*d* and 15*a*–15*d*, respectively. The purpose of the foregoing spiral finger portions is to generate a magnetic field in the space between the contacts 14 and 15 for implementing rotation of an arc (not shown) that is drawn between the contacts 14 and 15 upon separation thereof. Such rotation is about the axis of the contacts 14 and 15, in a generally circular path. The reason for having the arc thus rotated is to prevent the arc from unduly heating the contacts 14 and 15 by remaining at a solitary location on each of the contacts.

It has been discovered by the present inventors that the foregoing magnetic arc rotation feature of the vacuum interrupter 10 is adversely affected by a magnetic field generated by current flowing in the conductive leads 11 and 12. This is due to the configuration of these conductive leads, which includes a sharp bend between the conductive lead 11 and a contact stem 17, and a further sharp bend between the conductive lead 12 and a contact stem 18. This configuration results in a substantial magnetic field impinging or encroaching upon the space between the first and second contacts 14 and 15 (that is, the space where an arc is drawn), which magnetic field, in turn, results in a force that pushes such an arc to the rightmost portions of the contacts 14 and 15, as illustrated in FIG. 1. The present inventors have determined that such a force is capable of overcoming the force that would otherwise drive the arc around the contacts 14 and 15 in a generally circular path. As a result of this, the peak current interruption capability of the prior art vacuum interrupter 10 is substantially reduced.

OBJECTS OF THE INVENTION

Accordingly, it is an object of the present invention to provide an improved vacuum interrupter having conductive leads configured in a manner that results in a minimization of the magnetic field impinging upon the space between a pair of contacts of the vacuum interrupter due to current in the foregoing conductive leads.

It is a further object of the present invention to provide an improved vacuum interrupter having a higher peak current interruption performance than a vacuum interrupter having prior art conductive leads as described above.

It is a still further object of the present invention to provide an improved vacuum interrupter of the magnetic arc rotation type having a higher peak current interruption performance than the prior art vacuum interrupter of the magnetic arc rotation type described above.

Further objects and advantages of the present invention will become apparent from a reading of the remainder of this specification in conjunction with the drawing figures.

SUMMARY OF THE INVENTION

In carrying out the objects of the present invention in one form, there is provided an improved vacuum interrupter comprising an evacuated vessel having a generally cylindrical, conductive shield. In one inventive embodiment, first and second contacts of the magnetic arc rotation type are disposed within the conductor shield, are aligned with each other along a contact axis, and define a "mating" plane or interface therebetween when abutting each other. The improved vacuum interrupter further comprises first through fourth conductor means. The first conductor means projects externally of the evacuated vessel and is connected to the first contact. Likewise, the second conductor means projects externally of the vessel and is connected to the second contact. The third conductor means is connected to the first conductor means at a predetermined distance from the mating interface on a first side thereof. The fourth conductor means, apparently the most critical for the purposes of the present invention, is connected to the second conductor means, is disposed substantially concentrically and symmetrically about the contact axis, runs from a predetermined distance from the mating interface on the first side thereof to a predetermined distance from the mating interface on a second side of the mating interface, and, further, all points thereof are spaced between two different predetermined distances from the contact axis. The provision of the foregoing conductor means serves to minimize a magnetic field due to current therein that impinges upon the space between the first and second contacts. Additionally, the fourth conductor means serves as one of a pair of conductive leads of the vacuum interrupter and can be practically disposed in proximity with the other conductive lead (comprising a further conductor means).

BRIEF DESCRIPTION OF THE DRAWING FIGURES

DETAILED DESCRIPTION OF THE INVENTION

Figure 1:
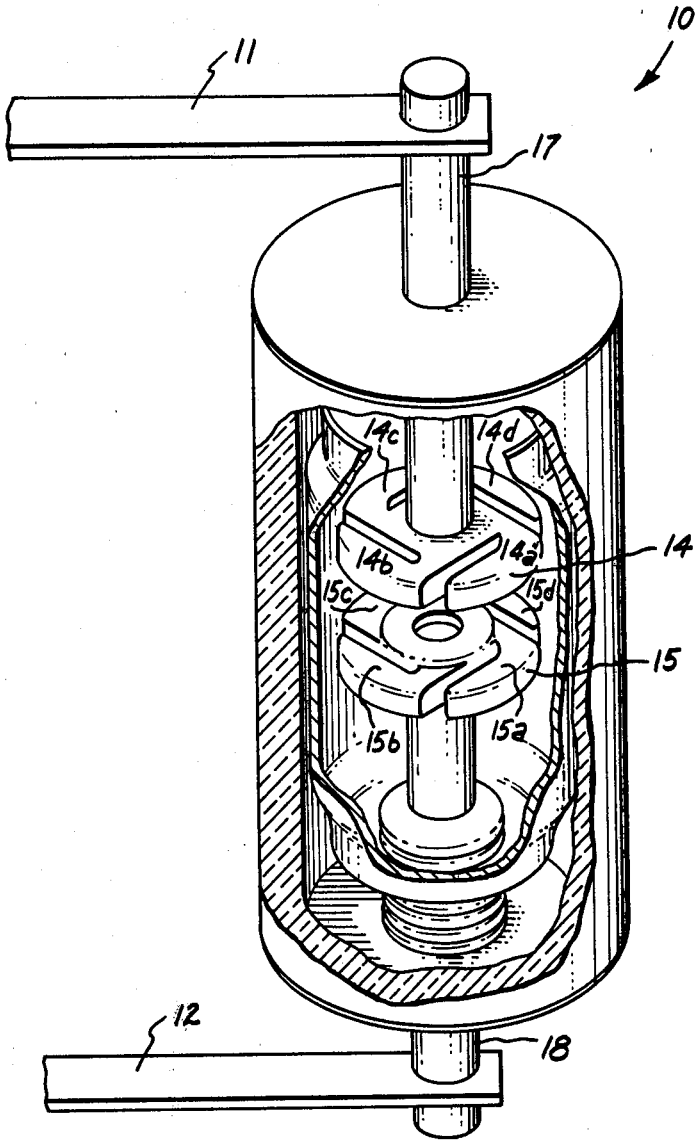
FIG. 1 PRIOR ART
FIG. 1 is a simplified or schematic view in perspective of a prior art vacuum interrupter with portions thereof partly broken away and having prior art conductive leads connected to contact stems of the vacuum interrupter.
Figure 2:
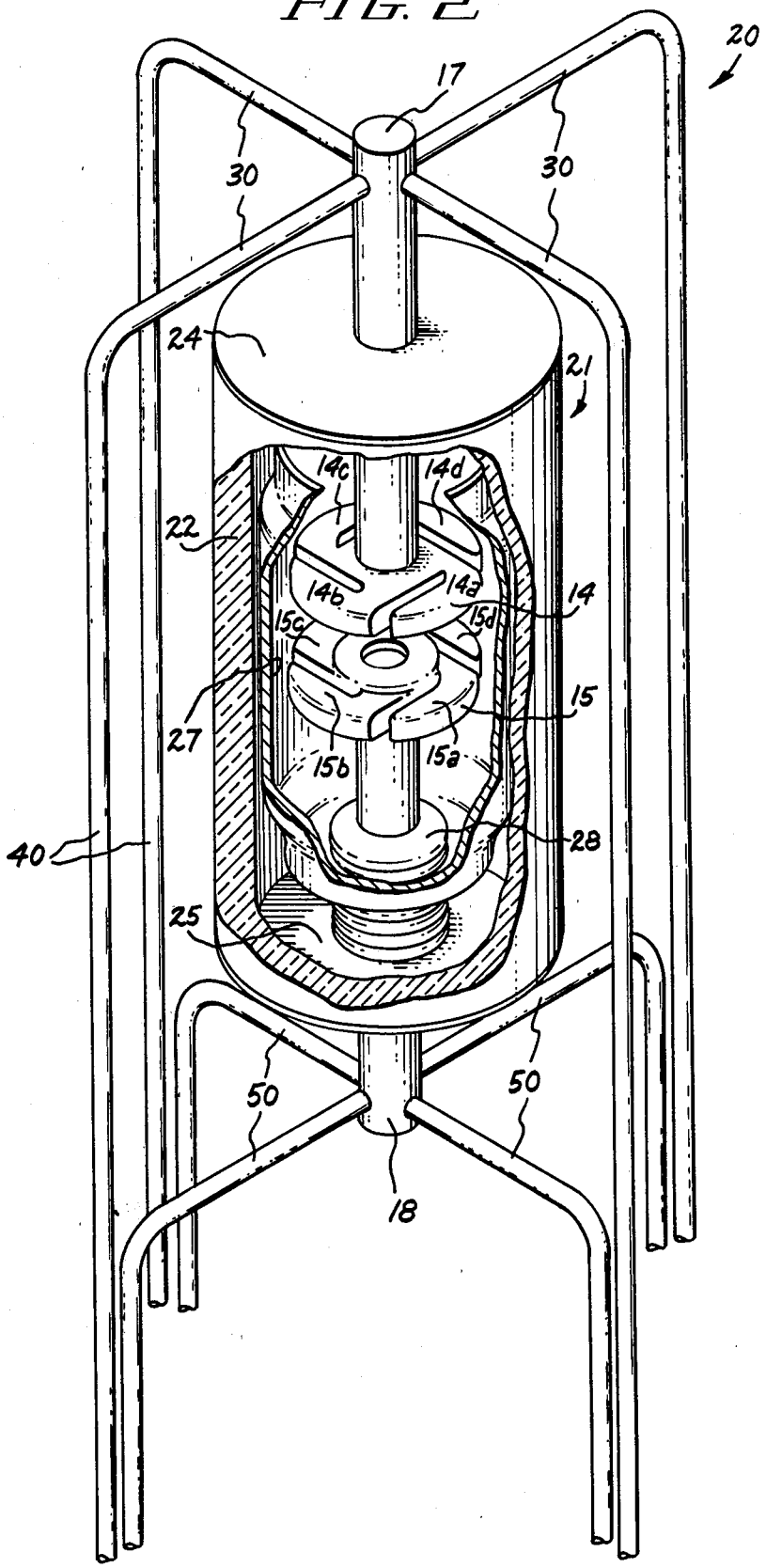
FIG. 2 is a view similar to FIG. 1 illustrating, however, a different configuration of conductive leads attached to contact stems of a vacuum interrupter in accordance with the present invention.

There is shown in FIG. 2 an improved vacuum interrupter 20 in accordance with a first embodiment of the present invention. The vacuum interrupter 20 suitably comprises the same arrangement of parts connected between contact stems 17 and 18 as in the prior art arrangement of parts between the contact stems 17 and 18 of FIG. 1, illustrating prior art.

The vacuum interrupter 20 comprises an evacuated vessel 21 suitably having an insulative housing 22, such as glass, and metallic end plates 24 and 25. Further, the evacuated vessel 21 contains a generally cylindrical, conductive shield 27 which is supported relative to the insulative housing 22 in the position illustrated by means (not shown), whereby the conductive shield 27 is often electrically isolated from both contact stems 17 and 18 and also from the metallic end plates 24 and 25. The present invention is equally applicable to an evacuated vessel 21 wherein a conductive shield 27 serves as an outer housing of the evacuated vessel 21 in the medial portion thereof. In such an arrangement, the insulative housing 22 would comprise upper and lower portions with the conductive shield medially connected therebetween. An example of the immediately foregoing alternative construction for the evacuated vessel 21 is described in H. Häbler and H. J. Lippmann, "Vacuum Interrupters for Primary Distribution Circuit-Breakers", Siemens Review, No. 12, December, 1977 pages5-56–559, incorporated herein by reference.

The vacuum interrupter 20 further comprises first and second, separable contacts 14 and 15 that are stationary and movable, respectively. In order to accommodate movement of the second contact 15 without loss of vacuum within the evacuated vessel 21, a bellows 28, typically formed from stainless steel, has an upper end connected to the contact stem 18 and a lower end connected to the metallic end plate 25. The bellows 28 is usually protected from deterioration due to striking arcs by a conductive shield (not shown) covering the bellows 28. The first and second contacts 14 and 15 are each disc-shaped and are substantially aligned with each other along a "contact axis" that passes through the centers of the contacts 14 and 15 and, in the specific vacuum interrupter 21 illustrated in FIG. 2, also through the centers of the contact stems 17 and 18. The first and second contacts 14 and 15 define a "mating" plane or interface therebetween when abutting each other.

The first and second contacts 14 and 15 have configurations which promote rotation of an arc (not shown), drawn between the contacts 14 and 15, in a generally circular path about the contact axis. In order to implement this magnetic arc rotation feature, the contacts 14 and 15 each have a plurality of finger portions **14*a*–14*d* or 15*a*–15*d* spiralling from a lesser radius of the respective contact to a greaater radius of the respective contact, with the respective finger portions of the first and second contacts 14 and 15 spiralling in opposite rotational directions as viewed from the mating interface. More specifically, each of the pluralities of finger portions 14*a*–14*d* and 15*a*–15*d* comprises four finger portions, each of which has a generally linear portion disposed at the peripheral edge of the respective contact, each of which is oriented substantially tangentially to the respective contact, and each of which has a length of approximately ½ of the diameter of the respective contact. Further details of the contacts 14 and 15** specifically illustrated herein are disclosed in U.S. Pat. No. 3,522,399—D. W. Crouch, which is assigned to the same assignee as is the present application, and which is herein incorporated by reference.

The present invention may also be practiced with first and second contacts 14 and 15 having different configurations for achieving a magnetic arc rotation feature than as specifically described above. First and second contacts 14 and 15 having different configurations, however, like the first and second contacts 14 and 15 specifically described above, each comprise finger portions spiralling from a lesser radius of the respective contact to a greater radius of the respective contact, with the respective finger portions of the first and second contacts 14 and 15 spiralling in opposite rotational directions as viewed from the mating interface. By way of example, suitable configurations of the first and second contacts 14 and 15 are disclosed in the above referenced article from *Siemens Review* and in U.S. Pat. No. 3,462,572—J. C. Sofianek, assigned to the same assignee as is the present application, and U.S. Pat. No. 3,852,555—Schuöcker et al. The foregoing patents, like the referenced article from *Siemens Review*, are incorporated herein by reference.

Suitable configurations for the first and second contacts 14 and 15 also include the "periodic electrode structure" contacts disclosed in U.S. Pat. No. 3,679,474—J. A. Rich, assigned to the same assignee as is the present application, and the simple butt contacts disclosed in C. W. Kimblin, "Dielectric Recovery and Shield-Currents in Vacuum-Arc Interrupters", *Proceedings of the IEEE Power Apparatus Systems*, Vol. 90(1971), pages 1261–1270. The foregoing two documents are incorporated herein by reference. Both the periodic electrode structure contacts and the simple butt contacts utilize magnetic fields that are weak, at best, compared to the magnetic field that can be generated between a pair of such contacts due to the configuration of the prior art conductive leads 11 and 12 of FIG. 1. Thus, an arc drawn between a pair of these contacts is subject to being driven to the rightmost portions thereof where the geometry of FIG. 1 is used. This contraint on the positioning of an arc diminshes the peak current interruption performance of a vacuum interrupter incorporating a pair of these contacts.

In accordance with the present invention, there are provided various conductor means for implementing current paths from circuitry (not shown) external of the vacuum interrupter 20 to the first and second contacts 14 and 15. The first contact stem 17 suitably comprises a first conductor means which is connected to the first contact 14 and which projects externally of the evacuated vessel 21. Similarly, the second contact stem 18 suitably comprises a second conductor means which is connected to the second contact 15 and which projects externally of the evacuated vessel 21.

More particularly, the second contact stem or second conductor means 18 comprises a generally linear and rod-like conductor extending away from the mating interface a predetermined distance that is preferably between 2 and 6 times the diameter of the first contact 14. What is meant by a "rod-like" conductor is a conductor constrained to about the same radius from the main or longitudinal axis thereof. As such, a rod-like conductor could be, by way of example, round, square, or rectangular (at least where its width is not much larger than its thickness).

In the particular inventive embodiment of FIG. 2, a third conductor means 30 comprises a plurality of four conductors which are shown as being horizontally disposed, although this configuration is merely exemplary. The third conductor means 30 is advantageously disposed substantially concentrically and symmetrically about the contact axis. The third conductor means 30 is connected to the contact stem or first conductor means 17 at a preferred distance from the mating interface of between approximately 2 and 6 times the diameter of the first contact 14.

A fourth conductor means 40 apparently is the most significant conductor means of the present invention. The fourth conductor means 40, as illustrated in FIG. 2, comprises a plurality of four conductors disposed substantially concentrically and symmetrically about the contact axis. In the specific inventive embodiment of FIG. 2, the plurality of four conductors of the fourth conductor means 40 are respectively connected to the plurality of four conductors of the third conductor means 30. Each of the plurality of conductors of the fourth conductor means 40 runs from a predetermined distance from the mating interface on a first or upper side thereof, as viewed in FIG. 2, to a further predetermined distance from the mating interface on a second or lower side thereof, also as viewed in FIG. 2. Both of the foregoing two predetermined distances are preferably between approximately 2 and 6 times the diameter of the first contact 14. All portions of the plurality of conductors of the fourth conductor means 40 are preferably spaced at a substantially uniform radial distance from the contact axis. However, all portions of the plurality of conductors of the fourth conductor means 40 can be advantageously spaced from the contact axis between a predetermined distance of approximately 2 times the diameter of the first contact 14 and a further predetermined distance of approximately 6 times such diameter.

The present invention may be advantageously practiced with a fifth conductor means 50, as illustrated in FIG. 2. The fifth conductor means 50 is connected to the second contact stem or second conductor means 18 at a predetermined distance from the mating interface on the second or lower side of the mating interface. This predetermined distance is preferably between approximately 2 and 6 times the diameter of the first contact 14. The fifth conductor means 50 is advantageously disposed substantially concentrically and symmetrically about the contact axis. The fifth conductor means 50 has a portion disposed in proximity to a portion of the fourth conductor means 40. In FIG. 2, such portion of the fifth conductor means 50 comprises the vertical conductors thereof. The significance of having such a proximate relationship between portions of the fourth and fifth conductor means 40 and 50 is that the magnetic field generated by these portions substantially cancel each other out. Thus, such magnetic fields do not significantly impinge upon the space between the contacts 14 and 15.

The provision of the various inventive conductor means described above serves to implement conductive leads to the vacuum interrupter 20 which are so configured as to minimize a magnetic field due to current in such inventive conductor means that could impinge upon the space between the first and second contacts 14 and 15, and thereby adversely interfere with an arc drawn between these contacts. This is especially important in the case where the contacts 14 and 15 have configurations for implementing a magnetic arc rotation feature, whereby the optimum functioning of such arc rotation feature is realized. The minimization of such magnetic field due to current in the various conductor means is primarily due to the symmetrical and concentric arrangement of each of the conductor means about the contact axis, as described above. Additionally, the spacing of the portions of the various conductor means from the mating interface and from the contact axis, as described above, serves to minimize the magnetic field due to current in the various conductor means.

In addition to the configuration and spacing of the various conductor means, a substantial increase in the peak current that can be interrupted by the vacuum interrupter 20 is attained by selecting suitable dimensions for the conductive shield 27 and the contacts 14 and 15 whereby these contacts are spaced inwardly from the conductive shield by at least a predetermined distance between about 0.5 and 1.5 inches. The best current interruption performance of the vacuum interrupter 20 is presently expected where the contacts 14 and 15 are substantially concentric with the conductive shield 27 and the predetermined distance between the contacts 14 and 15 and the conductive shield 27 is about 1.5 inches.

A comparison of the peak current interruption performance of the inventive vacuum interrupter 20 of FIG. 2 with such performance of the prior art vacuum interrupter 10 of FIG. 1 was conducted and indicated substantially better performance with the inventive vacuum interrupter 20. More specifically, an increase in performance of approximately 24% was attained with the inventive vacuum interrupter 20 employing the inventive first through fifth conductor means as configured in FIG. 2, and with the inventive vacuum interrupter 20 conforming to the following approximate dimensions:

| | |
|---|---|
| Diameter of each of the contacts 14 and 15 | 2.75 inches |
| Spacing between each of the contacts 14 and 15 and the conductive shield 27 | 0.63 inches |
| Distance from the junction of the first contact stem or first conductor means 17 and the third conductor means 30 to the mating interface | 5.50 inches |
| Length of each of the plurality of conductors of the fourth conductor means 40 from the uppermost portion thereof on the first or upper side of the mating interface to the mating interface | 5.50 inches |
| Length of each of the plurality of conductors of the fourth conductor means 40 from the highest portion thereof that is in proximity with the fifth conductor means 50 on the second or lower side of the mating interface to the mating interface | 7.00 inches |
| Spacing of each of the four conductors of the fourth conductor means 40 from the contact axis | 6.40 inches |
| Distance from the junction of the second contact stem or second conductor means 18 and the fifth conductor means 50 to the mating interface | 7.00 inches |

An even higher increase in peak current interruption performance of approximately 49% was attained by the inventive vacuum interrupter 20 with the foregoing configuration and dimensions applying except that the spacing between each of the contacts 14 and 15 and the conductive shield 27 was approximately 1.50 inches rather than 0.63 inches, as in the former case. It is to be understood that the foregoing dimensions are merely exemplary of one specific embodiment of the present invention, and that reference should be made to the above discussions of the various dimensions for other embodiments of the present invention.

Figure 3:
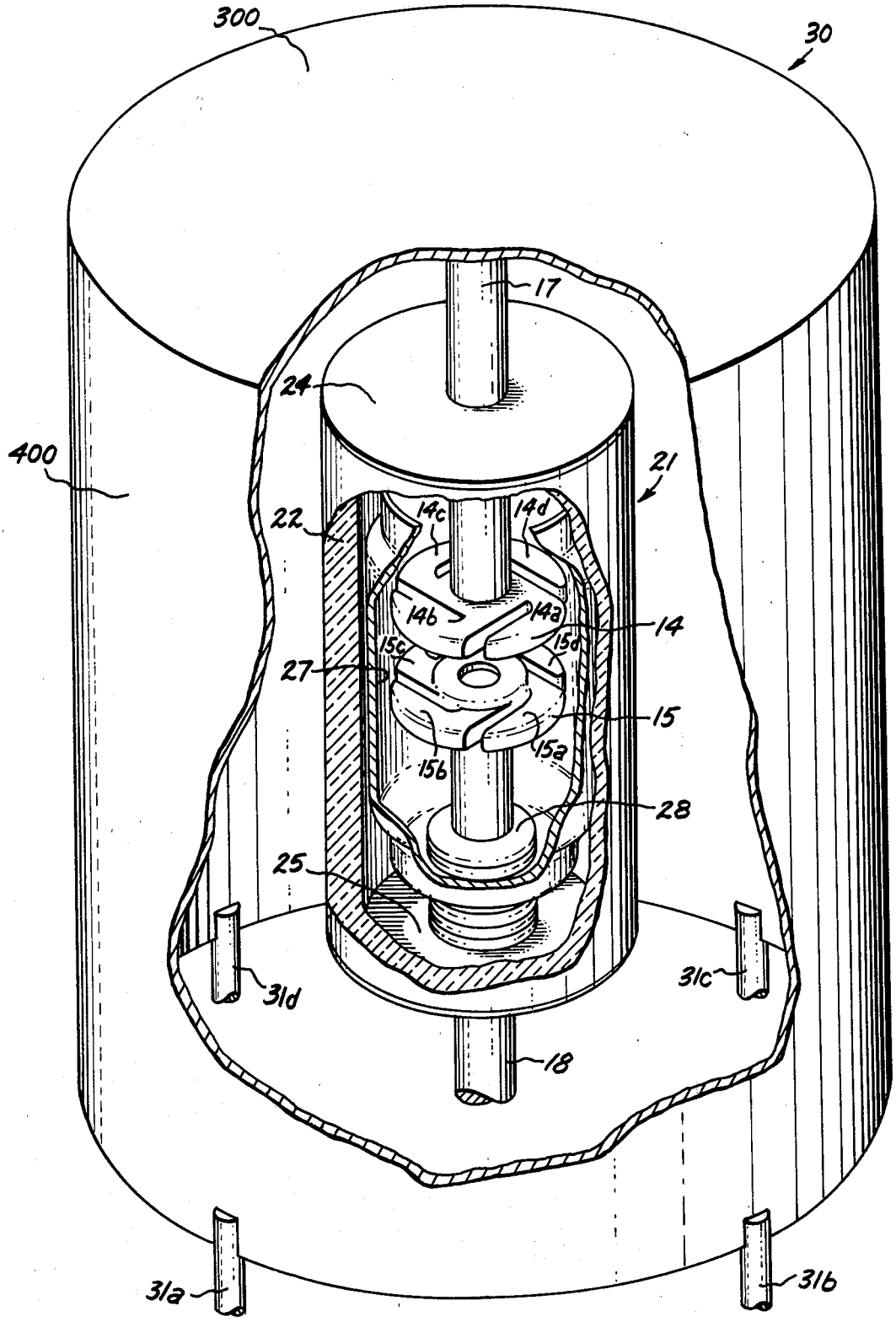
FIG. 3 is a view also similar to FIG. 1 illustrating a further configuration of conductive leads attached to contact stems of a vacuum interrupter in accordance with the present invention.

Turning to FIG. 3, there is shown a vacuum interrupter 30 in accordance with a further embodiment of the present invention. The vacuum interrupter 30, as illustrated, is identical to the vacuum interrupter 20 of FIG. 2, except for a different implementation of the third and fourth conductor means referenced as "300" and "400" in FIG. 3, respectively, and the absence of the fifth conductor means 50 of FIG. 2 which is not shown in order to facilitate understanding the vacuum interrupter 30. Accordingly, the above discussion of the various conductor means of the vacuum interrupter 20 also apply to the vacuum interrupter 30 of FIG. 3, except for the different implementations of the third and fourth conductor means 300 and 400.

The fourth conductor means 400 comprises a solitary conductor whereby it continuously circumscribes the contact axis. As specifically illustrated, the fourth conductor means 400 comprises a cylindrical conductor. Such a configuration represents the limiting case where the plurality of conductors of the fourth conductor means 40 of FIG. 2 constitutes an infinite number of conductors symmetrically disposed about the contact axis. It can thus be appreciated that the above discussions of the various dimensions of the present invention apply equally well to the fourth conductor means 400 (of FIG. 3) as they do the plurality of conductors at the fourth conductor means 40 (of FIG. 2). The fourth conductor means 400 is suitably connected to circuitry (not shown) external of the vacuum interrupter 30 via symmetrically spaced conductors 31*a*–13*d*. The second contact stem or second conductor means 18 is suitably connected to such external circuitry via conductors such as the fifth conductor means 50 of FIG. 2.

The third conductor means 300 as illustrated comprises a flat circular plate which is connected to the first contact stem or first conductor means 17 at the center of the plate and which is connected to the fourth conductor means 400 at the perimeter of the plate. As with the fourth conductor means 400, the third conductor means 300 represents the limiting case where the plurality of conductors of the third conductor means 30 of FIG. 2 comprises an infinite number of conductors symmetrically disposed about the contact axis. Thus, the above discussions of the various dimensions of the present invention apply equally well to the third conductor means 300 (of FIG. 3) as they do to the plurality of conductors of the third conductor means 30 (of FIG. 2).

While the present invention has been described with respect to specific embodiments, modifications thereof will occur to persons skilled in the art without departing from the spirit and scope of the invention as defined in the appended claims. For example, although the first and second conductor means have been shown as comprising the contact stems 17 and 18, these conductor means can equally well comprise other or further conductive structure. Additionally, the dividing line between the third and fourth conductor means need not be sharply delineated as in the inventive embodiments described above. In other words, the angle between these two conductor means can be obtuse as opposed to the approximately right angle illustrated in both FIGS. 2 and 3. The appended claims are deemed to cover the foregoing and all such modifications.

What is claimed as our invention and desired to be secured by Letters Patent of the United States is:

1. An improved vacuum interrupter, comprising:

(a) an evacuated vessel having a generally cylindrical conductive sidewall;

(b) first and second generally disc-shaped contacts disposed within said conductive vessel, and spaced inwardly from said conductive sidewall by at least a first predetermined distance, said contacts being substantially aligned with each other along a contact axis, and defining a mating interface when abutting each other;

(c) first conductor means projecting externally of said vessel and being connected to said first contact;

(d) second conductor means projecting externally of said vessel and being connected to said second contact;

(e) third conductor means connected to said first conductor means at a second predetermined distance from said mating interface on a first side of said mating interface, said distance being measured in a direction parallel to said contact axis; and (f) fourth conductor means connected to said third conductor means, said fourth conductor means being disposed substantially concentrically and symmetrically about said contact axis, said fourth conductor means running from a third predetermined distance from said mating interface on said first side thereof to a fourth predetermined distance from said mating interface on a second side of said mating interface, and spaced between fifth and sixth predetermined distances from said contact axis said third and fourth distances being measured in a direction parallel to said contact axis and said fifth and sixth dimensions being measured in a direction perpendicular to said contact axis, said second and fourth conductor means being parallel to each other for a finite extent and said fourth conductor means being oriented so as to carry current in a direction substantially parallel to said contact axis.

2. The invention of claim 1 wherein said second conductor means comprises a generally linear and rod-like conductor and extends a seventh predetermined distance from said mating interface on said second side thereof said seventh predetermined distance being measured in a direction parallel to said contact axis.

3. The invention of claim 1 wherein said first and second contacts each comprises a plurality of finger portions spiralling from a lesser radius of said respective contact to a greater radius of said respective contact, said respective finger portions spiralling in opposite rotational directions as viewed from said mating interface.

4. The invention of claim 3 wherein said respective pluralities of finger portions of said first and second contacts each comprises four finger portions, each of said four finger portions having a generally linear portion disposed at the peripheral edge of said respective contact, each being oriented substantially tangentially to said respective contact, and each having a length of approximately one-half the diameter of said respective contact.

5. The invention of claim 1 or 3 wherein said first predetermined distance is between about 0.5 and 1.5 inches.

6. The invention of claim 5 wherein said first predetermined distance is about 1.5 inches.

7. The invention of claim 3 wherein said third predetermined distance is between approximately 2 and 6 times the diameter of said first contact.

8. The invention of claim 7 wherein said fourth predetermined distance is between approximately 2 and 6 times the diameter of said first contact.

9. The invention of claim 8 wherein said second predetermined distance is between approximately 2 and 6 times the diameter of said first contact.

10. The invention of claim 8 wherein said fifth and sixth predetermined distances, respectively, are approximately 2 and 6 times the diameter of said first contact.

11. The invention of claim 2 wherein said seventh predetermined distance is between approximately 2 and 6 times the diameter of said first contact.

12. The invention of claim 1 wherein said third conductor means is disposed substantially concentrically and symmetrically about said contact axis.

13. The invention of claim 1 wherein said fourth conductor means comprises a plurality of conductors spaced substantially symmetrically about said contact axis.

14. The invention of claim 13 wherein said third conductor means comprises a plurality of conductors equal in number to said plurality of conductors of said fourth conductor means and which are respectively connected to said conductors of said fourth conductor means.

15. The invention of claim 14 wherein said plurality of conductors of said fourth conductor means comprises four conductors.

16. The invention of claim 1 wherein said fourth conductor means comprises a solitary conductor whereby it continuously circumscribes said contact axis.

17. The invention of claim 16 wherein said fourth conductor means is generally cylindrical in shape.

18. The invention of claim 16 wherein said fourth conductor means is substantially cylindrical in shape.

19. The invention of claim 16 wherein said third conductor means comprises a substantially flat, substantially circular plate connected to said first conductor means at approximately the center of said plate and connected to said fourth conductor means at the perimeter of said plate.

20. The invention of claim 1 wherein all portions of said fourth conductor means are spaced from said contact axis by a substantially uniform radial distance.

21. The invention of claim 2 further comprising a fifth conductor means, said fifth conductor means being connected to said second conductor means at said seventh predetermined distance from said mating interface on said second side thereof, being disposed substantially concentrically and symmetrically about said contct axis, and having a portion disposed in proximity to said fourth conductor means.

22. The invention of claim 21 wherein said fifth conductor means comprises a plurality of conductors.

* * * * *